United States Patent [19]

Hukill

[11] 4,063,377

[45] Dec. 20, 1977

[54] CHANGEABLE DISPLAY DEVICE

[76] Inventor: Marlin E. Hukill, P.O. Box 466, Seymour, Ind. 47274

[21] Appl. No.: 671,586

[22] Filed: Mar. 29, 1976

[51] Int. Cl.[2] ..... G09F 11/00

[52] U.S. Cl. ..... 40/28 C; 35/27

[58] Field of Search ..... 35/27, 28; 40/28 C, 40/68

[56] References Cited

U.S. PATENT DOCUMENTS

| | | | |
|---|---|---|---|
| 950,912 | 3/1910 | Harrington | 40/68 |
| 1,679,520 | 8/1928 | Giroux | 40/28 C |
| 3,740,878 | 6/1973 | Oelsclaeger | 40/28 C |

*Primary Examiner*—Louis G. Mancene
*Assistant Examiner*—Wenceslao J. Contreras
*Attorney, Agent, or Firm*—Woodard, Weikart, Emhardt & Naughton

[57] ABSTRACT

A changeable display device comprising a two-dimensional array of rotatable display elements. The display elements are generally flat and have sides of contrasting colors. The display elements are manipulated to selectively display one or the other of the contrasting colors. The display elements of the array thereby form a number which is surrounded by a contrasting color.

6 Claims, 10 Drawing Figures

CHANGEABLE DISPLAY DEVICE

BACKGROUND OF THE INVENTION

1. Field of the Invention

The present invention relates to a changeable display device having an array of several display elements, each display element having two different display surfaces.

2. Description of the Prior Art

Many business establishments utilize signs to advertise prices of certain key items. Gasoline filling stations, for example, generally advertise the price of gasoline, cigarettes or other products in this manner. Hotels, motels, automobile dealerships, and other roadside businesses similarly display prices or other information to the public. Because the prices or other information may vary with time, it is necessary that the sign be changeable to reflect these changes.

Some of the existing changeable signs provide for the numbers or letters to be removable from the basic structure of the sign. The sign is changed by removing the individual numbers or letters and replacing them with others. The individual characters are attached to the sign in a variety of ways. These signs, however, have at least three primary disadvantages. First, the user of the sign is required to select and store the proper combination of numbers and letters to enable him to display the desired variety of messages. The user is therefore burdened with the expense of maintaining the selection of display characters. Second, the display characters for some signs may be required to be five or more feet tall, and characters of this size are particularly unwieldy and susceptible to being lost or damaged. In addition, one or more characters in a particular display may be removed or otherwise become detached from the sign, thereby making the sign display incomplete.

It is therefore desirable to have a changeable display device which does not incorporate detachable elements. This has been accomplished by providing display devices which include an array of regularly-shaped display elements. Each display element typically has at least two sides of contrasting colors, and an equal number of display positions in which one of the sides is viewable from the front of the device. Each individual number or letter in the display is formed by positioning the appropriate arrangement of display elements to form that number or letter.

The primary requirements for a changeable display device of the latter description are that the display device be of simple and durable construction, and that the display positions of the display elements be quickly and conveniently changed. Preferably, the position changes should be possible to perform at a position remote from the sign, as where the sign is positioned high above the ground. In addition, it is necessary that the display device provide appropriate means for maintaining each of the display elements in the appropriate display position.

In U.S. Pat. No. 1,679,520, issued to Giroux on Aug. 7, 1928, there is shown a changeable sign which includes an array of flat display panels. Each display element is maintained in position by resilient clips which engage the adjacent panels. The Giroux device, however, does not provide a means for locking the display panels in position, as would be appropriate for a sign which is used outdoors. The display panels therefore may be easily manipulated by anyone having access to the sign in order to alter the intended message. In addition, a large sign, according to the Giroux patent, would comprise relatively large display panels which could be affected by wind and other natural phenomena to cause the individual panels to become disengaged.

A second locking or detent means is disclosed in U.S. Pat. No. 3,410,011, issued to Bowman, on Nov. 12, 1968. The Bowman device includes an array of three-sided elements. The display elements are maintained in display position by a resilient, foam material which is positioned to engage the corner of each display element opposite the visible side. Alternatively, the Bowman device includes a rigid plastic backing plate which has detent tabs for engaging the corners. The Bowman device, however, does not provide a means for preventing the display elements from being manipulated by a person having access to the sign. In addition, the utilization of three-sided display elements as in the Bowman device results in a display device which has increased construction costs and difficulties.

In U.S. Pat. No. 1,004,810 issued to Newell on Oct. 3, 1911, there is disclosed a transmutable display device having a two-dimensional array of display elements. Each of the display elements has generally two sides, the first being flat and the second being curved. The area between the two surfaces is open, and the display elements are suspended on a framework which includes rods which pass through the opening between the two surfaces. In one display position, the associated rod is received along the juncture between the flat and round surfaces with the flat surface being viewable from the front of the display device. To obtain the other display surface, the display element is rotated about the associated rod and allowed to slide downwardly so that the rod is then received at the opposite juncture of the flat and rounded surfaces. In this position, the rounded surface is viewable from the front of the display device. As with the prior art devices previously described, the Newell display device doesn't provide for securing the display elements in a particular display position, and does not permit the display positions of the display elements to be changed from a position remote from the display device.

Another display device utilizing an array of display elements having sides of contrasting colors is disclosed in U.S. Pat. No. 532,032 issued to Dalumi on Jan. 8, 1895. Each of the display elements is hingedly attached to the back wall of the sign, and includes a spring member which normally holds the display element in the down position. A cable is attached to each of the display elements to enable them to be rotated upwardly from a position remote from the sign. In one position, the exposed side of the display element and the surrounding back wall are the same color. When rotated to the other display position, the newly-exposed side of the display element and the potion of the back wall previously covered by the display element (when in the down position), have the same color, and that color contrasts with the color of the surrounding back wall. According to the Dalumi patent, the method for selectively positioning each of the display elements in one or the other display positions is initiated by first rotating all of the display elements to the up position. This is accomplished by rotating a drum to which each of the cables is attached. When in the up position, the display elements are engaged by a catch. An electromagnet is positioned above each of the catches and when activated, causes the catch to move away from the display element to permit it to rotate to the down position. Selection of those display elements which are desired to be in the down position is therefore accomplished by activating the proper electromagnets, after all of the display elements have been first moved to the up position. The Dalumi device does solve several of the problems associated with changeable display devices, but it does not provide a simple and inexpensive method for selectively positioning the various display elements.

SUMMARY OF THE INVENTION

A changeable display device is disclosed herein which comprises a two-dimensional array of rotatable display elements, each display element being generally flat and having sides of contrasting colors. Display elements which rotate about a central, transverse axis are mounted within a frame which is hingedly attached to a back wall. The display elements will not rotate when the frame is adjacent the back wall, but will rotate when the frame is swung away from the back wall. Display elements which include projections extending co-linearly from one edge of the display elements are mounted in a frame adjacent a back wall. The frame includes mutually-facing channels in which the projections are slidingly received. The projections may be positioned at the bottom of the channels with the display element rotated upwardly against the back wall, or the projections may be positioned at the tops of the channels with the display element rotated downwardly against the back wall. The display elements alternatively are hingedly attached to a vertical back wall and are operable to be positioned adjacent the back wall on one side or the other of the point of attachment to the back wall. Spring members normally hold the display elements in one position, and cables attached to the display elements permit the display elements to be rotated to the other of the display positions at a location remote from the display elements. Each of the cables is received within a conduit which extends from the back wall to the location remote from the sign.

It is an object of the present invention to provide a changeable display device having integral elements which may be selectively adjusted to exhibit variable expressions.

Another object of the present invention is to provide a changeable display device which may be quickly and conveniently adjusted.

Yet another object of the present invention is to provide a changeable display device which includes display elements which may be locked in position, thereby preventing unauthorized manipulation of the display elements.

It is a further object of the present invention to provide a changeable display device having display elements which may be changed from a position remote from the location of the display device.

Other objects and advantages of the present invention will become apparent from the figures and description which follow.

DESCRIPTION OF THE PREFERRED EMBODIMENTS

Figure 1:
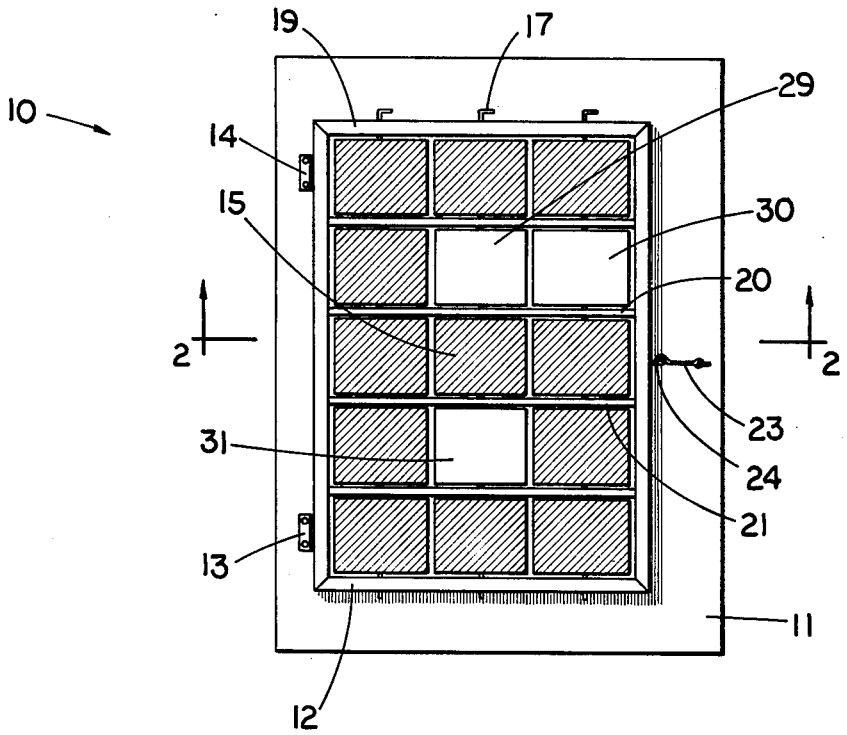
FIG. 1 is a front plan view of one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
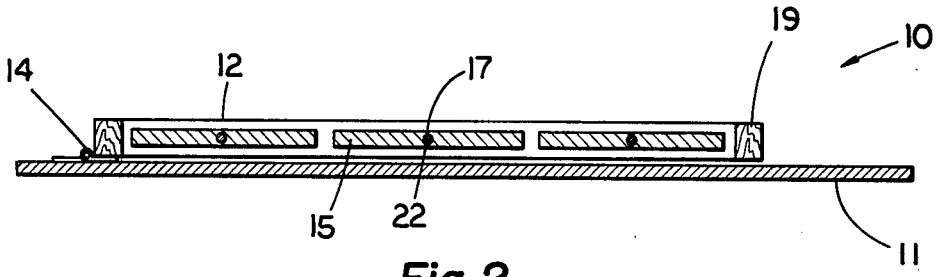
FIG. 2 is an end sectional view of the display device of FIG. 1, taken along the line 2—2 in the direction of the arrows.
Figure 3:
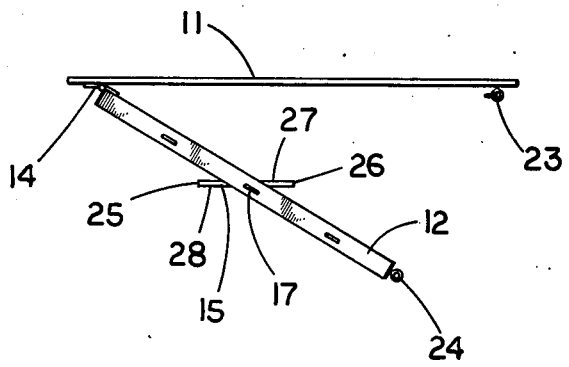
FIG. 3 is a top, end view of the display device of FIG. 1 showing the frame pivoted away from the back wall.

Referring in particular to FIGS. 1–3, there is shown a display device 10, according to the present invention. Display device 10 comprises back wall 11 and frame 12. Frame 12 includes frame perimeter 19 and internal spacing members, such as 20 and 21.

Mounted upon frame 12 is a two-dimensional array of identical display elements, such as 15. Each display element is flat, and has sides of contrasting colors. Display elements such as 15 define a central, transverse aperture such as 22 (FIG. 2), within which as associated support rod, such as 17, is received. Support rods, such as 17, extend through frame perimeter 19 and each of the internal spacing members, such as 20 and 21. Each of the display elements is mounted upon an associated support rod between adjacent spacing members. Display element 15, for example, is mounted upon rod 17 between spacing members 20 and 21.

Frame 12 is normally held against back wall 11. Hook 23 is attached to back wall 11 and engages eyelet 24, which is attached to frame 12. Other suitable attachment means may be utilized. When hook 23 is disengaged from eyelet 24, however, frame 12 is free to pivot upon hinges 13 and 14 away from back wall 11. In this position (FIG. 3), the display elements are free to rotate about the associated supporting rods. For example, display element 15 is free to rotate about rod 17 (FIG. 3). In this manner, the side of the display element which is visible from the front of the sign may be varied.

Display element 15 includes sides 27 and 28 of contrasting colors. Most preferably, the same two contrasting colors are used for each of the display elements. It is this feature that is relied upon in forming a number or letter by the display elements of the display device. In FIG. 1, display elements 29–31 have been positioned to have the darker of the contrasting colors visible from the front of the sign. The remainder of the display elements have the ligher sides visible. The numeral 6 is thereby formed by the display device with the display elements having the lighter side visible forming the 6 against the background of the darker sides of the other display elements and the dark color of the back wall and frame. The colors for the display elements are best chosen to have the darker color correspond with the color of the frame 12 and back wall 11, thereby forming a uniform background for the formed numbers or letters.

Once the display elements have been properly positioned to have the appropriate sides visible from the front of the sign, frame 12 is rotated upon hinges 13 and 14 against back wall 11. Each of the display elements includes free-swinging edges, such as 25 and 26 (FIG. 3), which are engaged by the back wall 11 when frame 12 is positioned adjacent thereto. In this manner, the various display elements are secured in their selected display positions.

The display device of this and the following embodiments preferably has 15 display elements for each number or letter which is desired to be formed. The 15 display elements are arranged with 5 display elements in each of the vertical columns and 3 display elements in each of the horizontal rows. Other combinations and arrangements of display elements may be desirable, according to the intended use for the display device. It has been found, however, that the described arrangement of the 15 display elements permits the most efficient formation of numbers or letters.

Figure 4:
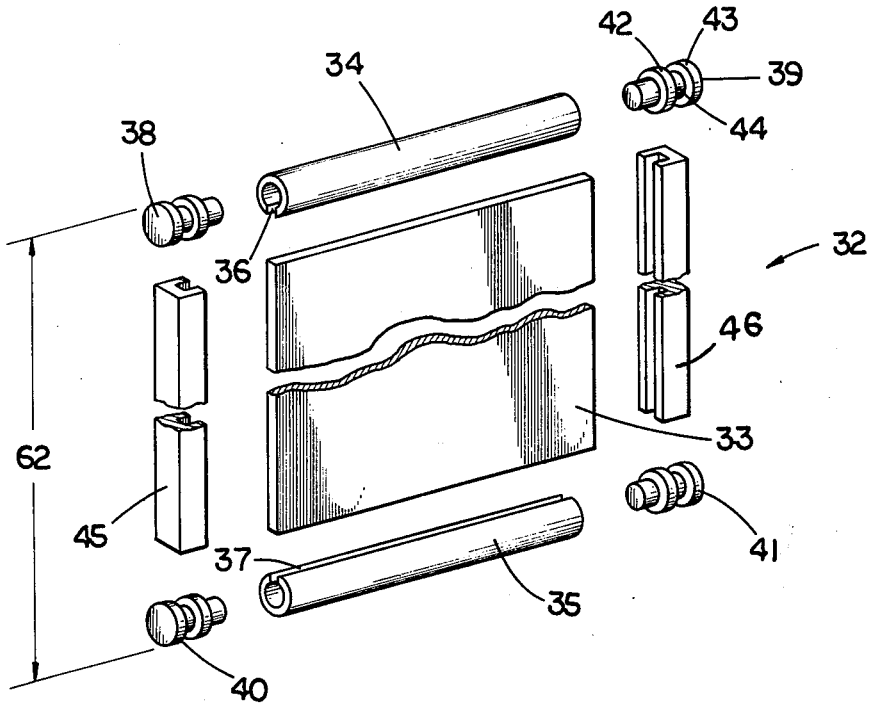
FIG. 4 is an exploded view of the display element used in a second embodiment of the display device.
Figure 5:
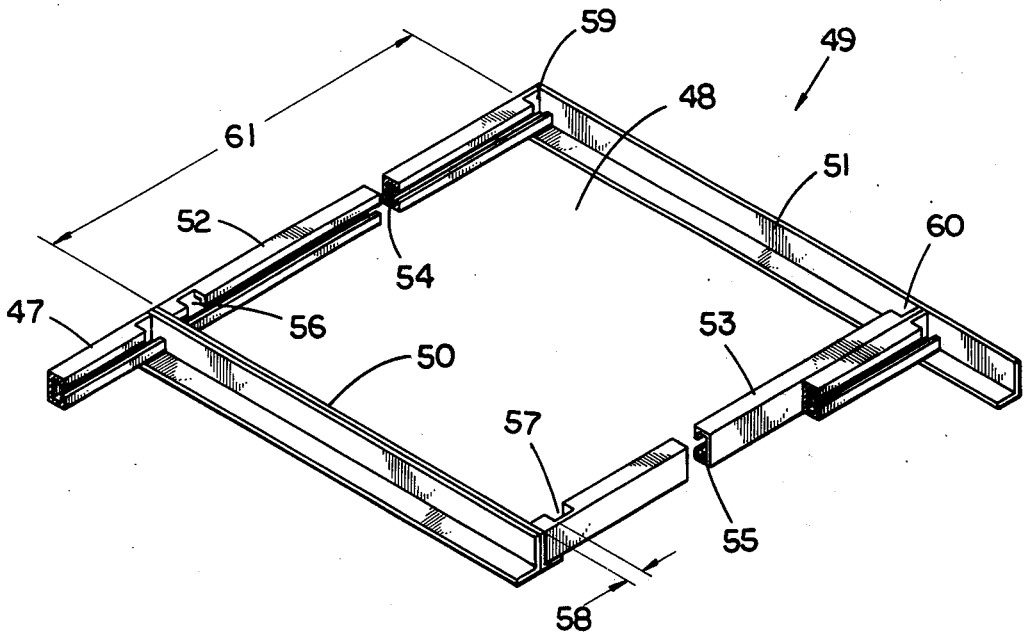
FIG. 5 is a perspective view of a portion of the support member of the second embodiment of the display device.

Referring now to FIGS. 4–8, there is shown a second embodiment of the present invention. The display device includes several display elements such as 32 (FIG. 4). Display element 32 includes a panel 33 having sides of contrasting colors. A framework is attached to the perimeter of panel 33 to provide structural support for the panel and to enable the panel to operate in the manner required by the present invention. Cylindrical frame members 34 and 35 have longitudinal slots 36 and 37, respectively, which receive opposite edges of panel 33. Pins 38–41 are received within the circular apertures defined by the opposite ends of cylindrical frame members 34 and 35. All of the pins are identical, and include enlarged cylindrical portions, such as 42 and 43, with a smaller cylindrical portion 44 therebetween. Rectangular frame members 45 and 46 are attached to opposite sides of panel 33.

Display elements such as 32 are received within a frame 47 (FIG. 5) Frame 47 is mounted upon back wall 48, and defines several individual frame enclosures, such as 49, for receiving each of the display elements. All of the individual frame enclosures are identical, and detailed description for only frame enclosure 49 (FIG. 5) will therefore be given. Enclosure 49 includes L-shaped member 50 which defines its bottom edge, and a second L-shaped member 51 which defines its top edge. C-shaped members 52 and 53 extend between the L-shaped members 50 and 51 and define opposite sides of enclosure 49. Members 52 and 53 define mutually-facing channels 54 and 55, respectively. Members 52 and 53 include bottom notches 56 and 57, respectively, which are located a distance 58 from the bottom edge of enclosure 49. Members 52 and 53 further include top notches 59 and 60, respectively, which are located a distance 61 from the bottom edge of enclosure 49.

Figure 6:
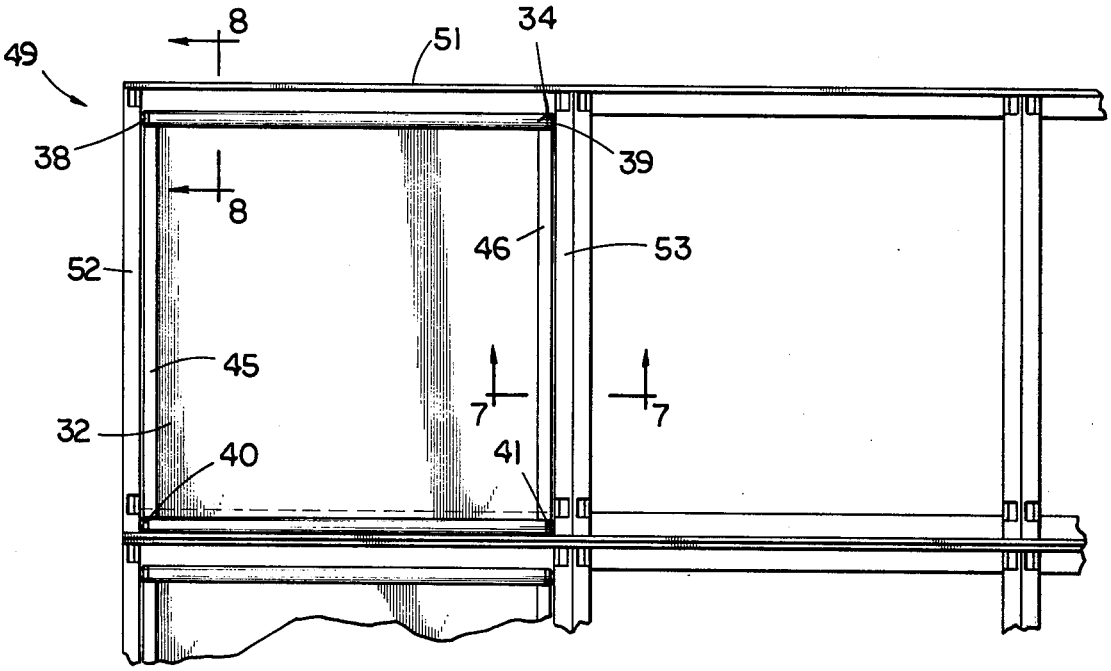
FIG. 6 is a front, plan view of a portion of the support member of the second embodiment of the display device, and showing a display element mounted therein.
Figure 7:
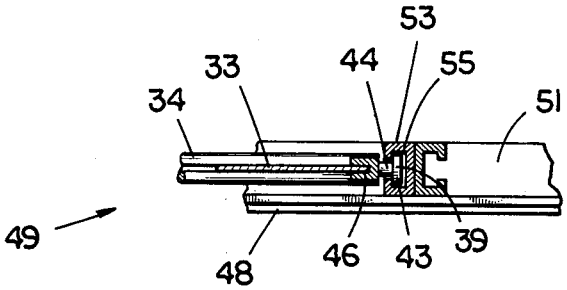
FIG. 7 is a partially broken, sectional view of the display device pictured in FIG. 6, taken along the line 7—7 in the direction of the arrows.

Each of the display elements operates identically with respect to the associated enclosure. Display element 32, for example, is received within enclosure 49 (FIG. 6). Each of the pins 38–41 is received within one of the associated channels defined by C-shaped members 52 and 53. Pins 38 and 40 are received within member 52, and pins 39 and 41 are received within member 53. The shape of the pins is complementary with the C-shaped members. For example, enlarged cylindrical portion 43 (FIG. 7) is received within channel 55, and smaller cylindrical portion 44 fits within the narrower opening to channel 55. The pins therefore cannot be removed from the channels except at the location of the notches.

With each of the pins 38–41 being received within the associated channels, display element 32 is in one of its two display positions. Retention of the pins within the associated channels maintains the display element in the selected display position, but the presence of the top and bottom notches in members 52 and 53 permit the display position of the display element to be changed. Changing of the display position of any one of the display elements may be accomplished in two ways. In the first display position, pins 40 and 41 rest within channels 54 and 55, respectively, a distance 58 (FIG. 5) below bottom notches 56 and 57. Similarly, pins 38 and 39 lie within channels 54 and 55, respectively, a short distance below top notches 59 and 60. This positioning of pins 38 and 39 is accomplished by locating top notches 59 and 60 a distance 61 (FIG. 5) from the bottom edge of enclosure 49, distance 61 being greater than the overall height 62 (FIG. 4) of the associated display element 32.

Figure 8:
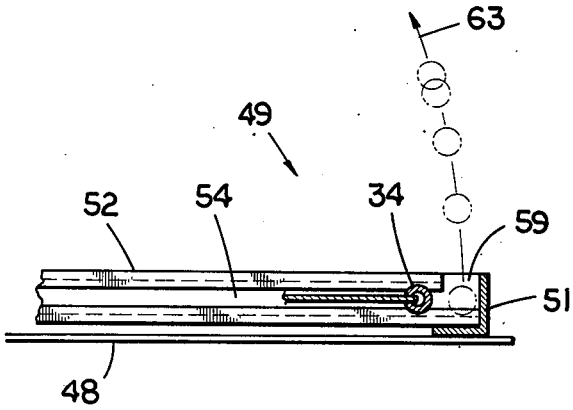
FIG. 8 is a partially broken, sectional view of the display device pictured in FIG. 6, taken along the line 8—8 in the direction of the arrows.

One method to change the display position of display element 32 is to move display element 32 upwardly until pins 38 and 39 are positioned even with top notches 59 and 60, respectively (FIG. 8). In this position, the top edge of display element 32 may be rotated from back wall 48 in the direction of arrow 63 (FIG. 8). Pins 40 and 41 may then be slid upwardly within channels 54 and 55, respectively, until they are positioned properly to permit pins 38 and 39 to be rotated through bottom notches 56 and 57 into channels 54 and 55. Display element 32 may then be allowed to drop to the bottom of the enclosure 49, and is then in the other of its display positions.

An alternative method (not shown) for changing the display position of display element 32 and other display elements is to move display element 32 upwardly until pins 40 and 41 are positioned even with bottom notches 56 and 57, respectively. The bottom of display element 32 may then be rotated away from back wall 48 and pins 38 and 39 allowed to slide downwardly toward the bottom of enclosure 49. Display element 32 is then positioned to permit pins 40 and 41 to be inserted through top notches 59 and 60, respectively, into channels 54 and 55. Again, the display element 32 is allowed to slide downwardly within the associated channels to move the pins out of alignment with the notches and to thereby secure display element 32 in the other of the display positions.

Both of these methods for changing the display position of a display element are analogous. The latter method is preferred, however, since it has been found that it is easier to permit the retained pins to slide downwardly within the channels than to have to force them upwardly. The distance between the top and bottom notches preferably is not equal to overall height 62 (FIG. 4) of display element 32. This insures that the display element will not easily be removed from the enclosure when the display position is being changed. The chance that the display element will be dropped and damaged during the changing of the display position is thereby substantially eliminated. The design of the display device does permit, however, the total removal of the individual display elements. This is advantageous in that it facilitates maintenance of the display device.

Any materials suitable for the use intended for the display device may be utilized in forming the components. The frame and back wall provide a rigid support for the display elements, and may comprise any suitable material, such as a metal or heavy plastic. The components of the display element may be readily and inexpensively formed from plastic materials with the provision for the contrasting colors for the two sides of panel 33 being accomplished by known techniques.

The described display device may be conveniently formed to have several display elements by combination of a number of smaller units. As indicated previously, a preferred combination of display elements has 5 parallel, horizontal rows. Each of the rows preferably contains 3 display elements, the display elements forming 3 vertical columns. A display device of this type is preferably formed by combining 5 smaller display units, each unit comprising one of the horizontal rows. Connection of the individual units may be accomplished by known techniques. Construction of the display device in this manner permits the unit to be more conveniently packaged and shipped prior to installation.

Construction of the display device from smaller units is particularly advantageous when the final display device is to have relatively large dimensions. Interstate road signs, for one example, used in advertising the price of gasoline and other items, are presently required to be located a substantial distance from the highway. As a result, the signs are generally required to be at least about five feet high in order to be easily read by persons travelling along the highway. The display device of the present invention permits the sign to be packaged and shipped in units which essentially represent only a fraction of the vertical height of the final, installed sign. In contrast, prior art devices in which single-unit numbers or letters were attached to a supporting structure would have required that the numbers or letters themselves be approximately five feet high. Characters of this size are expensive and difficult to ship, and are more susceptible to damage.

Figure 9:
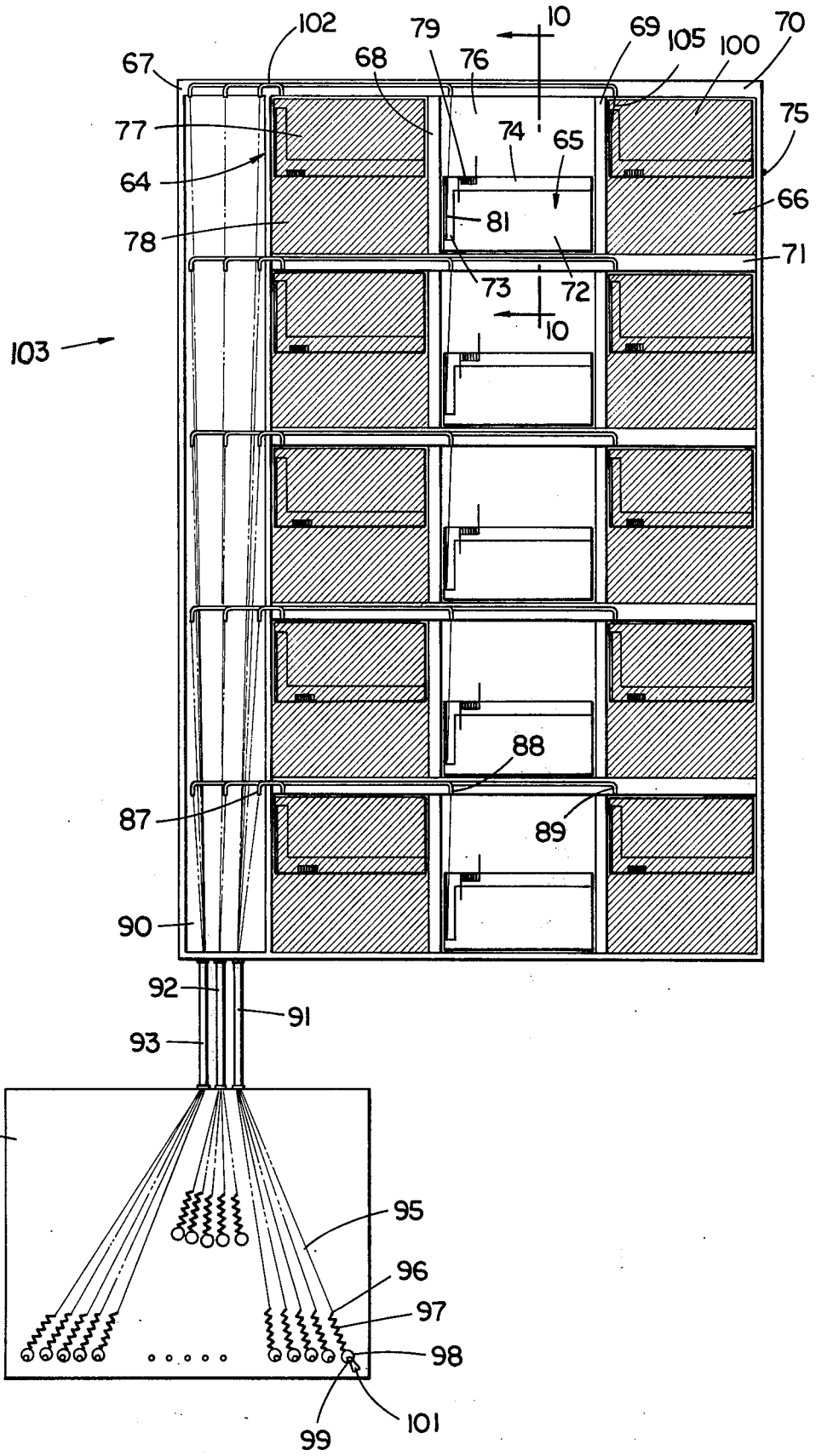
FIG. 9 is a front plan view of a third embodiment of the display device.
Figure 10:
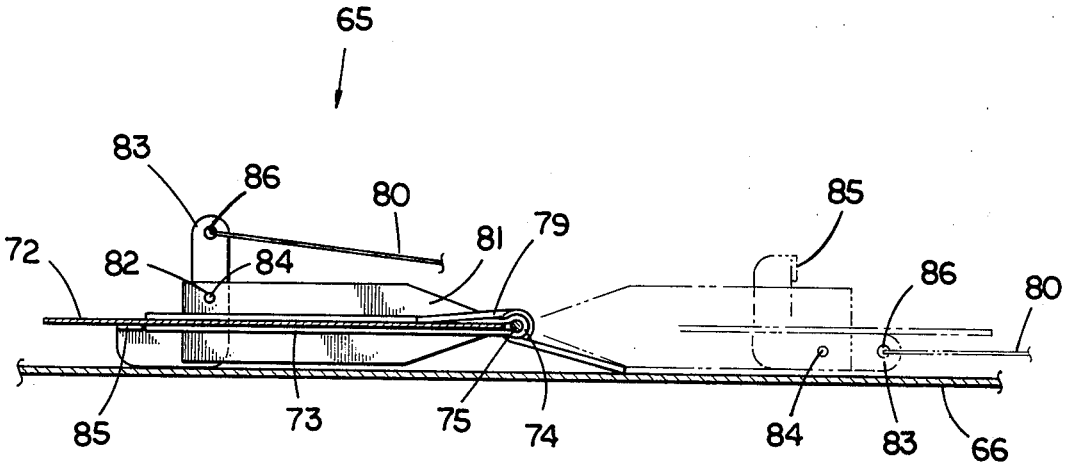
FIG. 10 is a partial side view of the display device of FIG. 9, taken along the line 10—10 in the direction of the arrows, showing the operation of the display elements.

Referring now in particular to FIGS. 9 and 10, there is shown a third embodiment of the display device of the present invention. Display device 103 comprises back wall 66 and framework 67. Framework 67 includes vertical spacing members such as 68 and 69, and horizontal spacing members such as 70 and 71. Mounted within framework 67 is a two-dimensional array of identical display elements such as 64 and 65. All of the display elements are identical, and detailed description of the only display elements 64 and 65 will therefore be given.

Display element 65 comprises a flat, rectangular panel 72 connected to an L-shaped support member 73. Support member 73 defines a hollow, cylindrical edge portion 74. Rod 75 extends horizontally through framework 67 and is received within cylindrical edge portion 74 between vertical spacing members 68 and 69. Display element 65 is thereby rotatable about rod 75.

Each of the display elements, such as 64 and 65, has opposite light and dark colored surfaces, and two display positions corresponding thereto. Display element 65 is shown (FIG. 9) is the first display position, in which the light-colored surface of panel 72 is visible from the front of the sign. A portion 76 of back wall 66, provided with a similarly light color, is located immediately above display element 65, and a light-colored square is thereby formed. In contrast, display element 64 is in the second display position. Display element 64 has been rotated about rod 75 from the first display position, and the dark-colored surface of panel 77 is visible from the front of the display device. A portion 78 of back wall 66 having a dark color identical to that of the dark surface of panel 77 is located immediately below display element 64. In the second display position, panel 77 covers the light-colored portion of back wall 66 which corresponds to portion 76. A dark-colored square is thereby formed. In this manner, squares of dark and light color may be selectively positioned on display device 63 to form a numeral, similar to the method of the previously-described embodiments.

Each of the display elements includes a spring 79 (FIG. 10) which normally holds the display element in the first display position. Spring 79 is a torsional, coiled spring, and includes a central passageway in which rod 75 is received. Cylindrical edge portion 74 of display element 65 includes a gap in which spring 79 may be positioned to receive rod 75.

Display device 103 is provided with several cables, such as 80, to permit the display positions of the various display elements to be changed from a location remote from the display device. Each of the cables is connected to one of the display elements. Support member 73 includes a flange 81 which extends perpendicularly to panel 72, and which includes an aperture 82. Member 83 is rotatably connected to flange 80 by pin 84, which extends into and is received by aperture 82. Member 83 includes flange 85 which extends under panel 72 when display element 65 is in the first display position. Member 83 further includes aperture 86 to which cable 80 is attached. By this combination of elements, cable 80 is connected to display element 65 at a point spaced apart from the plane of panel 72. Display element 65 may therefore be rotated upwardly by applying force to pull upwardly on cable 80. When force is so applied, flange 85 engages panel 72 and prevents member 83 from pivoting during the initial upward rotation of display element 65. Member 83 is free to pivot about pin 84, however, when display element 65 has been rotated upwardly a substantial extent. In this manner, member 83 may extend substantially from the surface of panel 72 to provide sufficient leverage to rotate display element 65 when force is applied to cable 80, but may pivot so that it does not prevent display element 65 from being fully rotated against back wall 66 (FIG. 10).

Each of the cables of display device 63 is received within a tube which extends from just above the respective display element to a channel 90 which extends vertically along one side of the display device. Again, the operation of each of these cables and associated conduits is identical, and therefore detailed description for only a few of these will be given. Conduits 87–89 (FIG. 9) correspond to one horizontal row of display elements, and extend into channel 90 which runs vertically along the left side of display device 63. Conduit 87 receives the cable attached to the display device in the vertical column closest to channel 90, and extends only as far as the right side of channel 90. Conduit 88 extends from the middle column of display device 63 to the center of channel 90, and conduit 89 extends from the right-hand column of display device 63 to the left side of channel 90. The positioning of the remainder of the conduits is similar.

As noted previously, it is advantageous to provide a display device which may be assembled from a number of smaller units. It is therefore preferred that display device 63 be assembled from several smaller units, each unit representing one of the horizontal rows of three display elements. The display device may then be formed from units identical to that which includes conduits 87–89.

Each of the cables extends through the associated conduits to one of the tubes 91–93 located at the bottom of channel 90. Preferably, each of the cables which connects to a display element in the left-hand, vertical column of display device 63 is received within tube 91. Similarly, cables extending to the display elements in the central and right-hand columns of display device 63 are received within tubes 92 and 93, respectively. Other combinations of cables with the positions within channel 90 and within the tubes such as 91–93, located at the bottom of channel 90, may be utilized as desired. One alternative, for example, would be to provide five tubes at the bottom of channel 90, each tube receiving the cables connected to the display elements in one of the horizontal rows of display device 63. Modifications may also be desirable or necessary if the display device 63 is provided with a number of display elements different than the preferred number and arrangement of 15 display elements depicted in FIG. 9.

Display device 63 further includes a control box 94 to which tubes 91–93 are connected. The control box may have any design which is considered convenient for the particular application of the display device 63. It is preferred, however, that the control box, as well as the other elements of display device 63, be essentially water tight and suited to outdoor use.

Each of the cables connected to the associated display elements extends through tubes 91–93 into control box 94. The operation of control box 94 with respect to each of the cables is similar, and therefore detailed description will be given only with relation to cable 95. Cable 95 connects to display element 64, which is located in the top, left corner of display device 63. Cable 95 extends through associated conduit 102 and into control box 94 through tube 91. An eyelet 96 is connected to the end of cable 95. Spring 97 is connected to eyelet 96 at one end, and eyelet 98 is connected to the other end of spring 97. Eyelet 98 is engaged by hook 99 which is attached to the interior of control box 94. In this manner, cable 95 is held in the extended position within control box 94 and display device 64 is thereby maintained in the second display position.

To facilitate the selection of the proper cables to be engaged by the corresponding hooks in order to form the desired number, tags, such as 101, may be connected to each of the cables, preferably by attachment to the eyelets, such as 98. The tags, such as 101, may be numbered or color-coded as desired to indicate the position of the display element to which the cable is connected. A key could also be formed which would indicate, by reference to the coating on the tags, the proper cables to be engaged by the associated hooks in order to form the various numbers of which may be desired. In FIG. 9, for example, the key would indicate that the cables extending through tube 92 should remain in the unextended position, whereas the remaining cables should be engaged by the respective hooks, in order to form the numeral one.

While the invention has been illustrated and described in detail in the drawings and foregoing description, the same is to be considered was illustrative and not restrictive in character, it being understood that only the preferred embodiments have been shown and described and that all changes and modifications that come within the spirit of the invention are desired to be protected.

What is claimed is:

1. A changeable display device which comprises:

a support member including a back wall and a frame;

several generally flat display elements having first and second sides of contrasting first and second colors, respectively, said display elements being connected to said support member to form a two-dimensional array, each display element having a free-swinging edge and an opposite, attaching edge, each display element being rotatable about the attaching edge, said back wall being positioned to engage the free-swinging edge of each of said display elements when said display element is rotated in the direction of said back wall; and said frame including several mutually-facing first and second channels having first and second ends, each of said display elements including first and second projections extending from and being generally co-linear with the attaching edge, the first and second projections of each associated display element being operable to slide within the associated first and second channels, respectively, each of said display elements having a first display position in which the associated first and second projections are near the first ends of the associated channels and the first side of said display element faces said back wall, and having a second display position in which the associated first and second projections are near the second ends of the associated channels and the second side of said display element faces said back wall, said device further comprising front retaining means for retaining said display elements in one of the display positions.

2. The device of claim 1 in which said front retaining means includes several front retaining members, each front retaining member being operable to engage the free-swinging edge of one of said display elements.

3. The device of claim 2 in which each of said display elements includes a third projection which is receivable within the first associated channel, the third projection being located a first distance from the attaching edge of said display element and a second distance from the free-swinging edge, the first associated channel including a front wall having a first notch further from the first end than the second distance and having a second notch further from the first end than the first distance, each of the notches being sized to permit the third projection of the associated display element to pass therethrough when said display element is rotated about the associated first and second projections.

4. The device of claim 3 in which each of said display elements includes a fourth projection which is receivable within the second associated channel, the fourth projection being located a third distance from the attaching edge of said display element and a fourth distance from the free-swinging edge, the second associated channel including a front wall having a first notch further from the first end than the fourth distance and having a second notch further from the first end than the third distance, each of the notches in the second associated channel being sized to permit the fourth projection of the associated display element to pass therethrough when said display element is rotated about the associated first and second projections.

5. The device of claim 4 in which said display elements are positioned in parallel, essentially-vertical columns and parallel, essentially-horizontal rows, each column and each row comprising several display elements, the attaching edges of each display element being horizontal, the channels being essentially vertical and the lower end of each of the channels being the first end of the channel.

6. The device of claim 5 which includes at least fifteen display elements.

* * * * *